US005964631A

United States Patent [19]

Choi et al.

[11] Patent Number: 5,964,631

[45] Date of Patent: Oct. 12, 1999

[54] METHOD AND APPARATUS OF INSERTING SUPPORT PINS INTO A CATHODE RAY TUBE PANEL

[75] Inventors: Joo Ho Choi, Kyungki-do; Jong Phil Choi; Ki Moon Lee, both of Suwon; Dae Young Kim, Seoul; Seong Jin Jung, Kyungki-do, all of Rep. of Korea

[73] Assignee: Samsung Corning Co., Ltd., Kyungki-do, Rep. of Korea

[21] Appl. No.: 08/917,104

[22] Filed: Aug. 25, 1997

[30] Foreign Application Priority Data

Aug. 30, 1996 [KR] Rep. of Korea ..... 96-36699

[51] Int. Cl.[6] ..... H01J 9/236

[52] U.S. Cl. ..... 445/30; 445/66; 445/23

[58] Field of Search ..... 445/23, 30, 66

[56] References Cited

U.S. PATENT DOCUMENTS 3,497,339 2/1970 Eastus .
3,695,860 10/1972 Katuta ..... 445/30
3,701,185 10/1972 Renssen ..... 445/30
4,267,624 5/1981 Augsburger ..... 445/30

*Primary Examiner*—Sandra O'Shea
*Assistant Examiner*—Todd Reed Hopper
*Attorney, Agent, or Firm*—Lowe Hauptman Gopstein Gilman & Berner

[57] ABSTRACT

A method and apparatus is provided whereby a shadow mask support pin can be forced into a cathode ray tube panel without having to use any panel support post. Three or four support pads are utilized to support the bottom edge of the skirt portion of the panel. Each of the support pads may be elevationally moved by a drive unit. First through fourth distance sensors serve to detect the height of corner points on the interior surface of the panel face portion. A control device is adapted to control the operation of the drive unit in a manner that the corner points are brought into a predetermined reference plane before the support pin insertion proceeds. A fifth distance sensor may be further employed to detect the height of a center point.

14 Claims, 8 Drawing Sheets

METHOD AND APPARATUS OF INSERTING SUPPORT PINS INTO A CATHODE RAY TUBE PANEL

FIELD OF THE INVENTION

The present invention pertains to a method and apparatus for inserting metallic shadow mask support pins into the interior surface of the skirt portion of a cathode ray tube panel.

DESCRIPTION OF THE PRIOR ART

Cathode ray tubes that are utilized in the manufacture of polychromatic television sets or computer monitors include a panel or face plate 10, a funnel 12 and a neck 14, as illustrated in FIG. 1 by way of example. The panel 10 is provided with a face portion 16 serving as a viewing screen and a skirt portion or flange 18 coupled to the funnel 12. On the interior surface of the panel 10, a layer of fluorescent material is applied so as to create images as electron beams are shot by an electron gun 20. A shadow mask 22 having a multiplicity of fine pores for electron beam passage is supported to the skirt portion 18 with an accurately selected spacing from the inner surface of the face portion 16.

Inserted into the inside of the skirt portion 18 of the panel 10 are three or four metal support pins or studs 24 which provide support for the shadow mask 22 described above. In order for the cathode ray tube to offer an enhanced quality of images, there is a need to position the shadow mask 22 and hence the support pins 24 in an extremely precise manner, in addition to the face portion 16 of the panel 10 being free from any optical defects and being of accurate curvature. Positioning the support pins 24 in an inaccurate location makes it impossible to maintain a uniform spacing between the face portion 16 of the panel 10 and the shadow mask 22, leading to unacceptable quality of images.

Typically, the panel 10 is produced by way of melting glass material in a furnace at the temperature of about 1500° C. and press forming the molten glass into a desired shape. The shaped pannel is allowed to cool down with air and then transferred to a pin sealing station wherein metal support pins preheated to a working temperature is inserted into the panel. At the termination of pin inserting process, the panel is passed through a lehr prior to reaching a grinding station wherein the exterior surface of the face portion of the panel is ground into a smooth surface. The interior surface of the panel face portion is precisely shaped by a plunger operated upper mold in the press forming station.

The curvature of the interior surface of the panel face portion should fall within the tolerable error range regardless of the mold wear and the variation in the cooling efficiency. For this reason, it has been the general practice in the art that the panel is periodically sampled at a location between the pin sealing station and the grinding station to measure it's curvature. Reference is made to FIG. 2 of the drawings which shows a panel 10 with metal support pins 24 inserted into it's flange 18. The representative curvature value CC of the interior surface of the panel face portion 16 can be calculated as follows by measuring the height of the center point and two diagonally opposite corner points:

$$CC=HO-(HA+HB)/2$$

where HA denotes the height of a first corner point A, HB the height of a second corner point B and HO the height of the center point C, as measured from the plane on which the support pins lie. The curvature value CC indicates the degree of shrinkage of the panel in the cooling process of the press and should be kept close to a predetermined reference value in order to minimize dispersion or scattering of the panel dimension. Thus the field workers have to regulate the cooling temperature of the lower mold of the press on a sporadic basis, based on the representative curvature value CC as measured.

The process of inserting the metal support pins 24 into the skirt portion 18 of the panel 10 is carried out by a plurality of pin insertion machines, at which time the panel 10 remains cooled down to an appropriate temperature. The use of the pin insertion machines in multiple numbers is to match the pin inserting speed to the press forming speed of the panel. The pin insertion machines are adapted to utilize a high frequency current to induce heat in the support pins 24 which will be then forced into the interior surface of the panel skirt portion 18.

Reference is made to FIGS. 3 through 5 of the drawings which show by way of exmple the state-of-the-art pin insertion machine for inserting support pins 24 into the skirt portion 18 of a panel 10. The pin insertion machine includes a fixed support 26 and a movable support 28 both cooperating to support the inner surface of the face portion 16 of the panel 10. As can be seen in FIG. 4, the fixed support 26 comprises a stationary base 30 from which first and second posts 32, 34 project upwards to support two corner points on the interior surface of the panel face portion 16 lying along a first diagonal line. On the contrary and as clearly noted in FIG. 5, the movable support 28 includes a stationary base 36, a horizontal yoke 40 connected at it's center to the base 36 via a spring 38 for floating movement with respect to the base 36 and third and fourth posts 42, 44 extending upwards from the opposite ends of the horizontal yoke 40 to support two corner points on the interior surface of the panel face portion 16 lying along a second diagonal line.

Further elements of the pin insertion machine include a plurality of pin transformers 48 which are mounted on a table 46 to preheat the support pins 24 and subsequently force them into the interior surface of the panel skirt portion 18. A pair of Y-axis direction guide pins 50 and a pair of Y-axis direction depressing devices 52 are provided in a confronting relationship with each other, whereas an X-axis direction guide pin 54 and an X-axis direction depressing device 56 are mounted in a spaced apart relationship with each other. The Y-axis direction depressing devices 52 serve to push the panel 10 placed on the table 46 against the Y-axis direction guide pins 50. Similarly, the X-axis direction depressing device 56 functions to push the panel 10 against the X-axis direction guide pin 54, thus securing the panel 10 in place. Such type of pin insertion machine is well known to those versed in the art and, for instance, is taught in U.S. Pat. No. 3,497,339 to Eastus dated Feb. 24, 1970.

As set forth supra, the shadow mask support pins 24 may adversely affect the quality of the cathode ray tube in case of the fixing position thereof being inaccurate. In an offort to insert the support pins 24 at a precise and accurate position, the prior art pin insertion machines are designed to lay down the panel 10 on a "post" plane defined by the tip ends of the posts 32, 34, 42, 44 and, through the use of the depressing devices 52 and 56, have the panel 10 secured immovably at that position before the support pins 24 are inserted into the panel skirt portion 18 with a preselected distance from the post plane. When viewed in X-Y coordinates whose origin coincides with the center of the panel 10, the positions of the respective post 32, 34, 42,

| | |
|---|---|
| A(−xp, yp) | C(xp, yp) |
| D(−xp, −yp) | B(xp, −yp) |

wherein A and B are contact points with the panel of the fixed posts 32, 34 and C and D are contact points with the panel of the movable posts 42, 44.

It is the basic in plane geometry that three points or three conditions suffice to define a plane. This means that the post plane on which contact points A, B, C and D lie can be found by way of calculating the height of points A and B and the slope of the segment interconnecting points C and D. Given that the height of contact points A, B, C and D is represented by HA, HB, HC and HD, the equation of the post plane will be as follows:

$$z = \left(\frac{1}{2} - \frac{x}{4xp} + \frac{y}{4yp}\right)HA + \left(\frac{1}{2} + \frac{x}{4xp} - \frac{y}{4yp}\right)HB + \left(\frac{x}{4xp} + \frac{y}{4yp}\right)(HC - HD)$$

Three or four shadow mask support pins are inserted into the panel skirt portion 18 a predetermined distance below the post plane as obtained above. During the entire process of inserting the support pins 24, it is required that the individual posts 32, 34, 42 and 44 should continue to be in contact with the interior surface of the panel face portion 16 for a time period of 20–30 seconds. Since the interior surface of the panel face portion 16 will be used as a viewing screen, care should be taken not to create marks or cracks at the contact points of the posts. There would be a possibility that the marks could occur at the post contact points in case of the panel temperature remaining too high as it is transferred from the press station to the pin inserting station. On the contrary, the panel would be cracked due to the thermal shock when the temperature thereof remains overly low.

Taking these possible problems into account, a conveyor is disposed in the prior art panel production system between the press station and the pin inserting station to assure that the panel can be cooled down to an appropriate temperature during it's conveyance. In addition, a heater is built in the respective post to make it's temperature generally equal to that of the panel, thereby preventing the panel from thermal shock and the attendant cracking. For the purpose of improving durability, the individual posts are made from heat resistant and wear resistant material.

According to the conventional pin insertion machines as set out above, there may occur not infrequently such an instance that post marks and cracks are created on the panel mainly because of the failure to manage the process conditions over time. Furthermore, the use of an excessively large amount of cooling air to draw down the temperature of the mold and the panel to an acceptable level tends to widen the size difference between the successively produced panels as well as to produce a great amount of noise.

Moreover, the layout of the factory becomes lengthy due to the employment of an elongated conveyor for transportation of the panel from the press to the pin inserting machines. It takes a substantial length of time to attach the support pins to a single panel, which requires that a plurality of pin inserting machines be used in parallel to equate the pin inserting speed with the panel forming speed in the press. This makes quite bulky the devices of transferring, feeding and removing the panel into and out of the pin inserting machines.

Additionally, the use of panel support posts entails a drawback in that the pin inserting machine grows complicated in it's overall structure. Setting aside the production costs of the posts, the post supporting type pin inserting machine has no choice but to employ a heater for maintaining constant the post temperature throughout the pin inserting process, a movable support for forming a regulated post plane and a holddown device for depressing the panel downwardly to assure positive contact between the panel and the posts.

In addition to the problems inherent in the pin inserting machine, need has existed for an improved method of making the curvature of successively produced panels uniform and consistent. It has been the conventional practice that the field workers bring the pin-inserted panel out of the main flow line to measure it's representative curvature value CC and, based on this value, regulate the cooling air flow rate to control the temperature of the lower mold of the press and hence the panel curvature. Since the measurement of the representative curvature value is made manually and sporadically, difficulty resides in detecting the curvature error of each and every panel in a speedy and precise manner. Controlling the lower mold temperature on the basis of the worker's optional determination makes it difficult to eliminate the curvature deviation of the individual panels.

SUMMARY OF THE INVENTION

With the prior art shortcomings noted above in mind, it is therefore an object of the invention to provide a pin inserting method and apparatus that can accurately position a cathode ray tube panel without resort to panel support posts, thus removing such defects as post marks and cracks which would otherwise be left on the interior surface of the panel Another object of the invention is to provide a pin inserting method and apparatus that enables a press formed cathode ray tube panel to be directly transferred to a pin inserting station without having to go through any further cooling stage, e.g., a cooling coveyor.

A further object of the invention is to provide a pin inserting method and apparatus capable of significantly shortening the pin inserting time, eliminating the possibility of panel rupture in a lehr and greatly reducing the number of pin inserting machines employed in a pin inserting station.

A still further object of the invention is to provide a pin inserting method and apparatus which can automatically detect the representative curvature value of each and every panel to feedback control the temperature of a press in response to the panel curvature variation, thereby maintaining the curvature of the panel within the range of permissible tolerance.

According to one aspect of the invention, a method of inserting a support pin into a cathode ray tube panel with a face portion and a skirt portion comprises the steps of supporting the skirt portion of the panel at a plurality of support points, measuring the height of corner points on a interior surface of the panel face portion, determining whether the respective corner point lies in a predetermined reference plane, changing the height of the support points to bring the corner points into the reference plane, when at least one of the corner points is determined to be out of the reference plane, and causing the support pin to be inserted into the skirt portion of the cathode ray tube panel.

According to another aspect of the invention, an apparatus of inserting a support pin into a cathode ray tube panel with a face portion and a skirt portion comprises a generally horizontal table, a plurality of support pads mounted on the table for hight-adjustably supporting the skirt portion of the panel, drive means for causing the support pads to move in a generally vertical direction, first to fourth distance sensors provided on the table for detecting the height of four corner points on the interior surface of the panel face portion, control means for determining whether the respective corner point lies in a predetermined reference plane and for energizing the drive means to bring the corner points into the reperence plane when at least one of the corner points is determined to be out of the reference plane, and means for causing the support pin to be forced into the skirt portion of the panel.

BRIEF DESCRIPTION OF THE DRAWINGS

The above and other objects, features, advantages of the invention will become apparent from a review of the following detailed description of the preferred embodiment taken in conjunction with the accompanying drawings, in which.

DETAILED DESCRIPTION OF THE PREFERRED EMBODIMENTS

Figure 1:
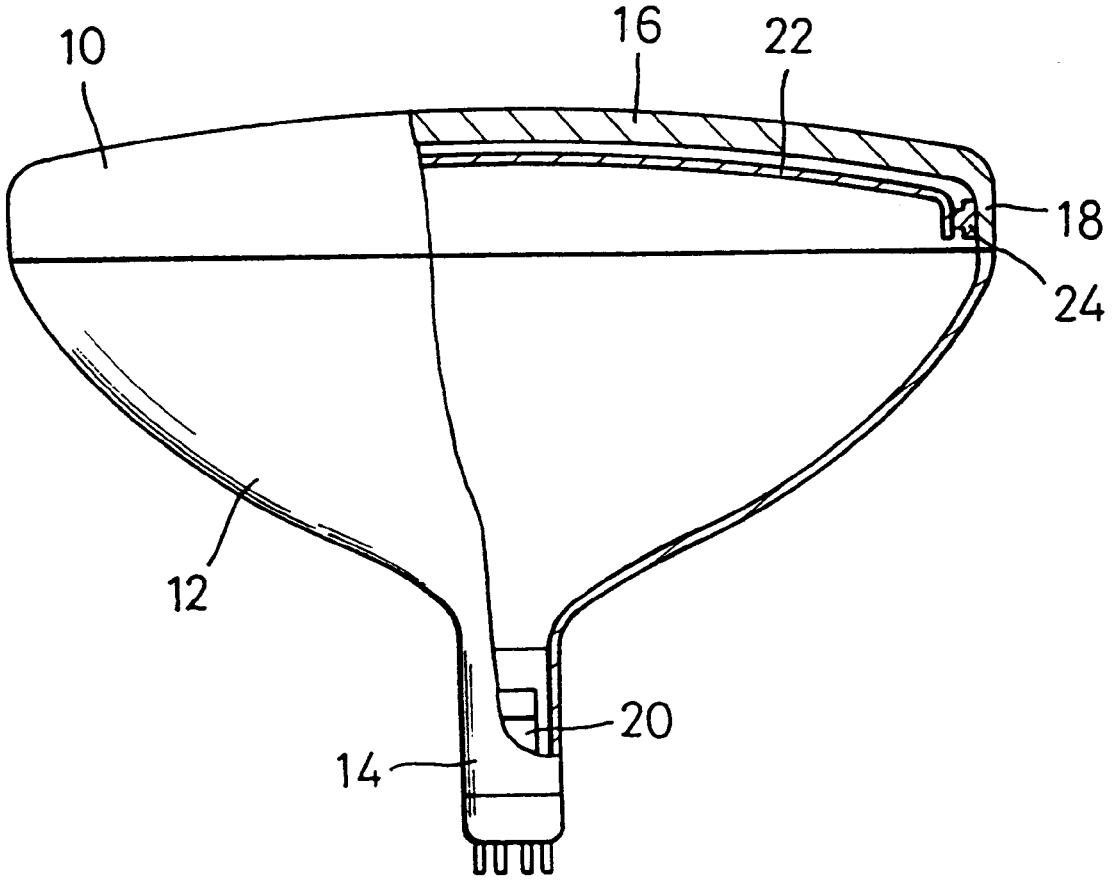
FIG. 1 is a partially cutaway perspective view showing a conventional cathode ray tube having a shadow mask supported by metal support pins.
Figure 2:
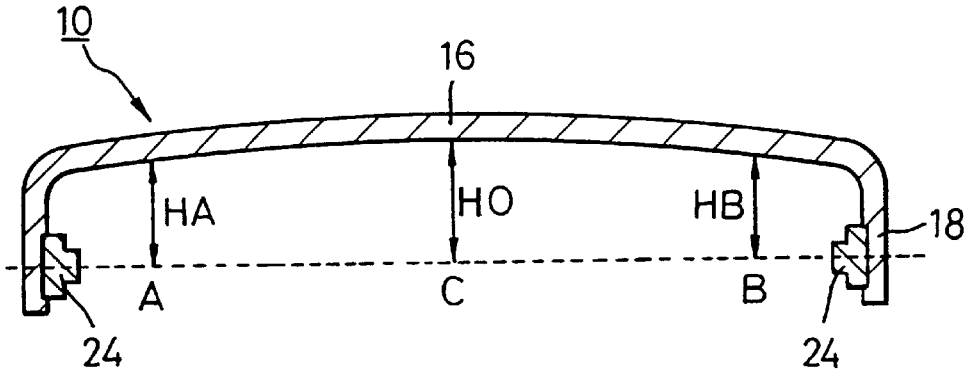
FIG. 2 is an enlarged sectional view best illustrating the metal support pins inserted into the skirt portion of a cathode ray tube panel.
Figure 3:
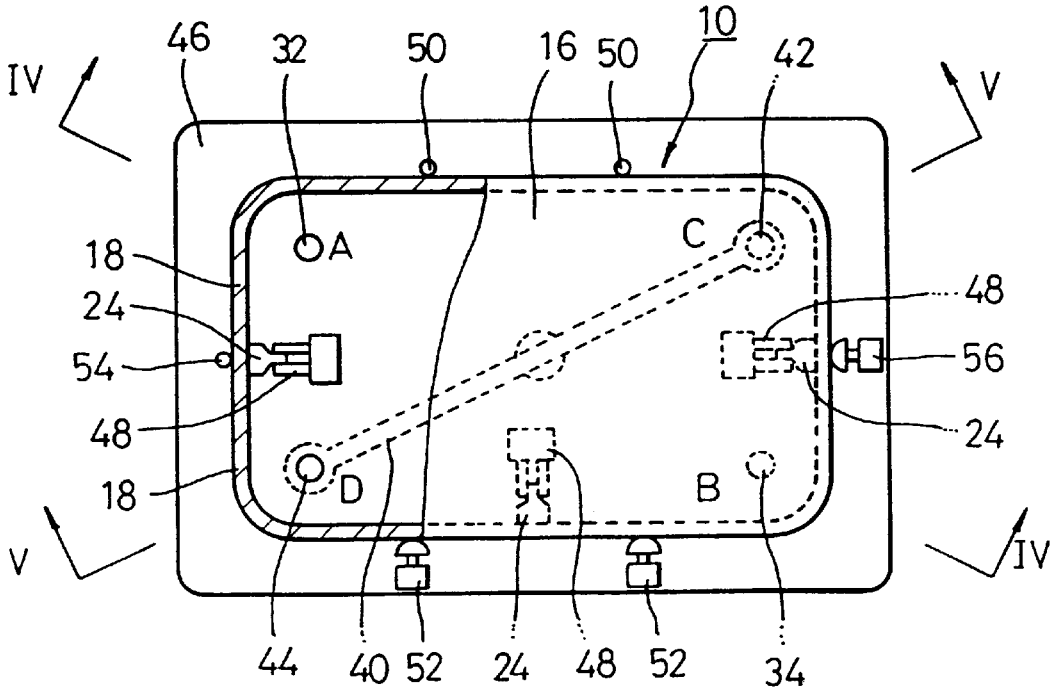
FIG. 3 is a schematic top view showing a prior art pin inserting machine with a panel placed thereon.
Figure 4:
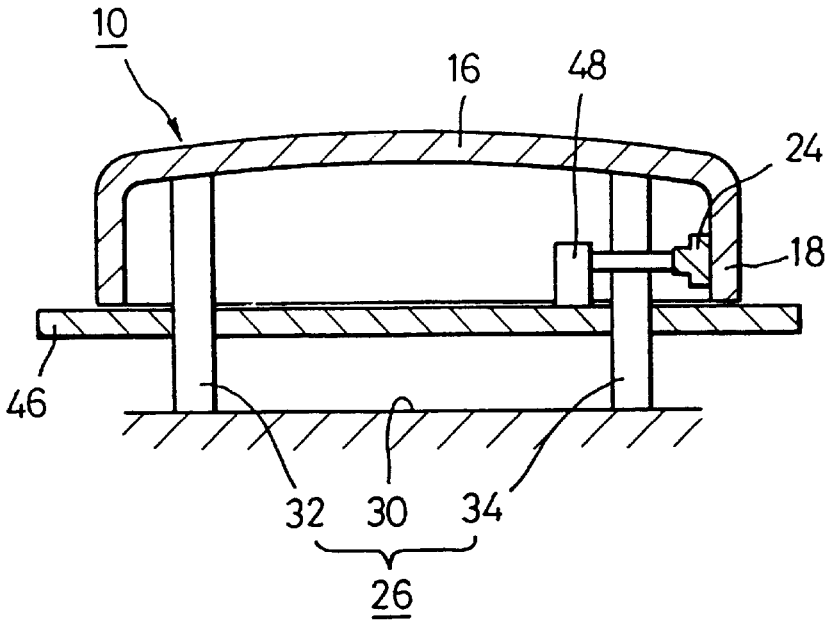
FIG. 4 is a sectional view taken along line IV—IV in FIG. 3, indicating the panel supported by a pair of fixed posts.
Figure 5:
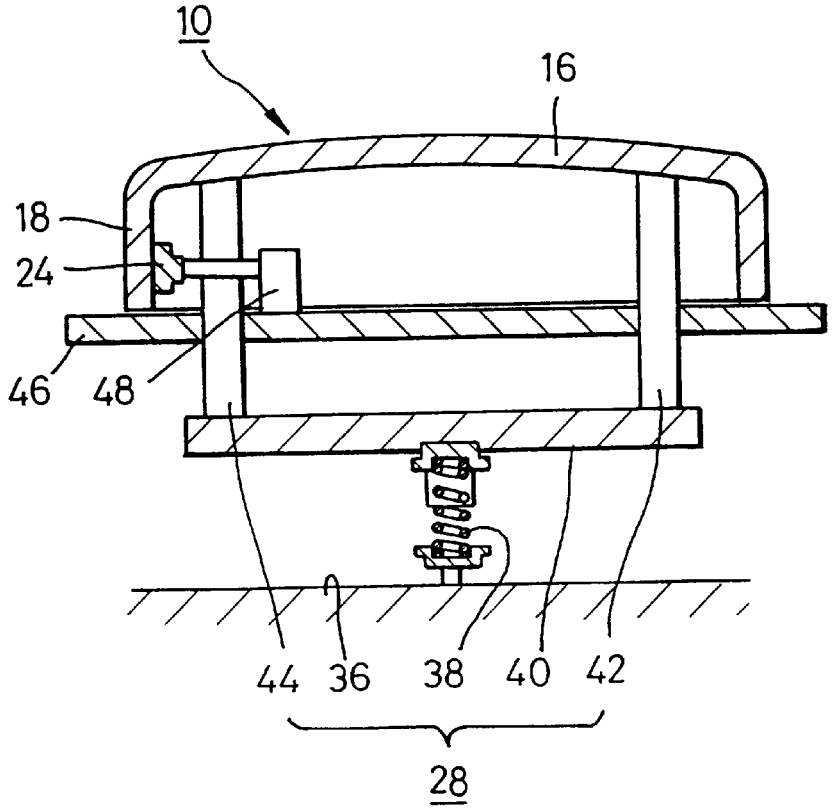
FIG. 5 is a sectional view taken along line V—V in FIG. 3, indicating the panel supported by a pair of movable posts.

Referring now to FIGS. 6 through 9, it will be noted that a pin inserting apparatus in accordance with the first embodiment of the invention includes a generally horizontal table 100 which can receive a cathode ray tube panel 102 transferred from a press forming station. The panel 102 is provided with a face portion 104 of convex configuration and a skirt portion 106 extending downwards from the face portion 104. It should be understood that the inventive pin inserting apparatus is equally applicable to a panel with a face portion of flat shape.

Figure 6:
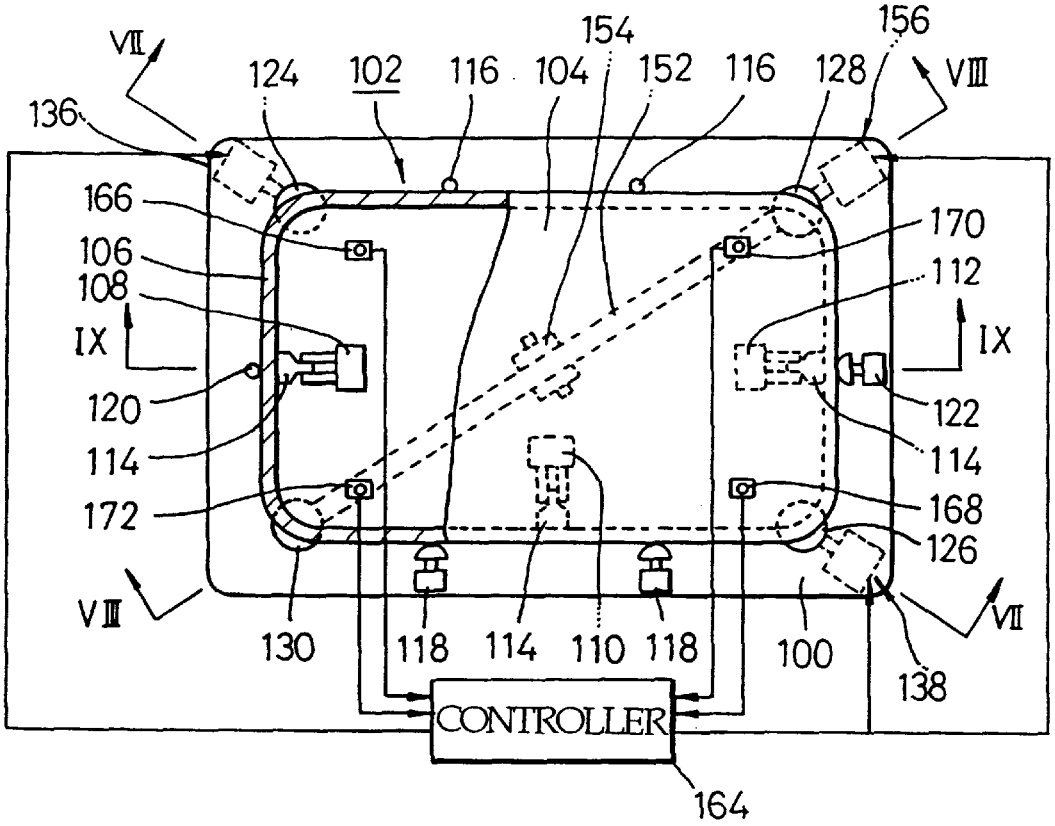
FIG. 6 is a top view showing a pin inserting apparatus in accordance with the first embodiment of the invention.
Figure 7:
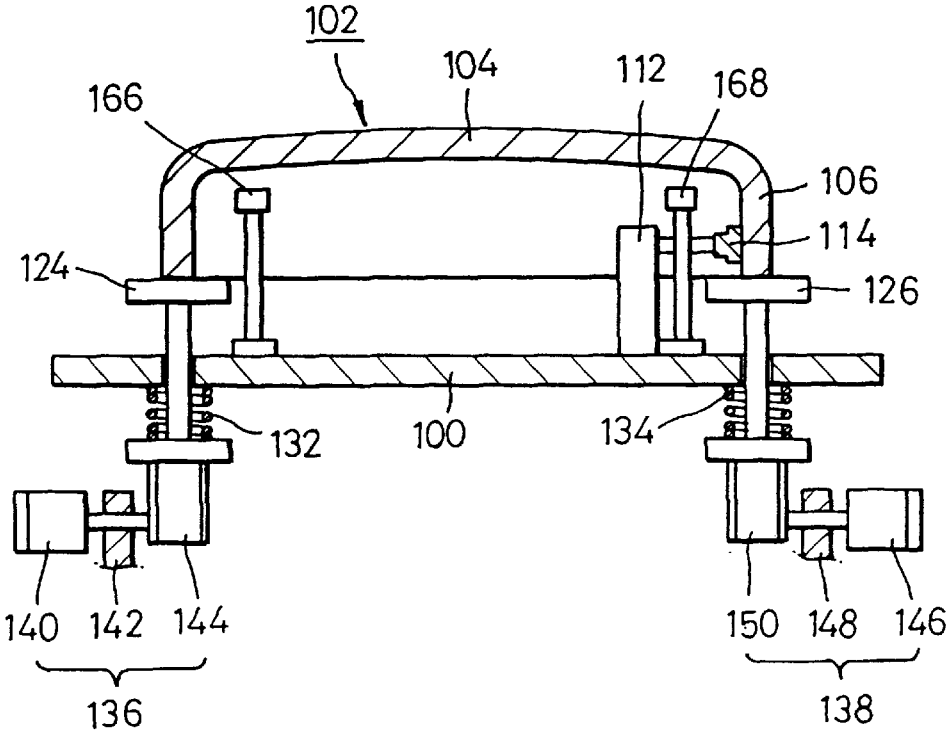
FIG. 7 is a sectional view taken along line VIl—VII in FIG. 6.

Fixedly mounted on the table 100 are first through third pin transformers 108, 110, 112, each of which receives a shadow mask support pin 114 from a pin feeding device not shown in the drawings and force it into the skirt portion 106 of the panel 102 just after the pin has been heated to a desired temperature by use of, e.g., a high frequency current. Although the pin inserting apparatus is shown in FIG. 6 to have three pin transformers by way of example, it would be possible to provide four pin transformers so that the support pin can be inserted into every side of the panel skirt portion.

A pair of Y-axis direction guide poles 116 are attached to the table 100 in a confronting relationship with respect to a pair of Y-axis direction clamping devices 118, whereas an X-axis direction guide pole 120 is affixed to the table 100 in a confronting relationship with respect to an X-axis direction clamping device 122. The Y-axis direction clamping devices 118 serve to depress the panel 102 against the Y-axis direction guide poles 116 to thereby secure it in a Y-axis direction. Similarly, the X-axis direction clamping device 122 functions to depress the panel 102 against the X-axis direction guide pole 120 to secure it in an X-axis direction. Such clamping devices 118, 122 may be a solenoid, a pneumatic cylinder or other suitable actuator means. As an alternative, the panel clamping may be effected through the use of roller clamping devices each mounted on the table for movement toward and away from the interior surface of the panel skirt portion. Use of the roller clamping devices would enable the vertical position of the panel to be regulated even after it has been secured in the X-axis and Y-axis directions.

Elevationally movably mounted on the table 100 are first and second independently adjustable support pads 124, 126 and first and second interlockedly adjustable support pads 128, 130, each supporting the bottom edge of the panel skirt portion 106 at four corners thereof. As clearly shown in FIG. 7, the first and second independently adjustable support pads 124, 126 are arranged along a first diagonal line of the panel 102 and normally biased in the downward direction by means of springs 132, 134.

First and second drive units 136, 138 are used to cause elevational movement of the support pads 124, 126. The first drive unit 136 includes a stepping motor 140 with an output shaft 142 and a cam 144 carried at the end of the output shaft 142 of the stepping motor 140. The cam 144 remains in contact with the bottom surface of the first independently adjustable support pad 124, whereby the support pad 124 can move up and down in response to the forward and reverse rotation of the stepping motor 140. Likewise, the second drive unit 138 includes a stepping motor 146 with an output shaft 148 and a cam 150 attached to the end of the output shaft 148 of the stepping motor 146. Since the cam 150 continues to be in contact with the bottom surface of the second independently adjustable support pad 126, rotation of the stepping motor 146 enables the support pad 126 to be adjusted in it's height.

Figure 8:
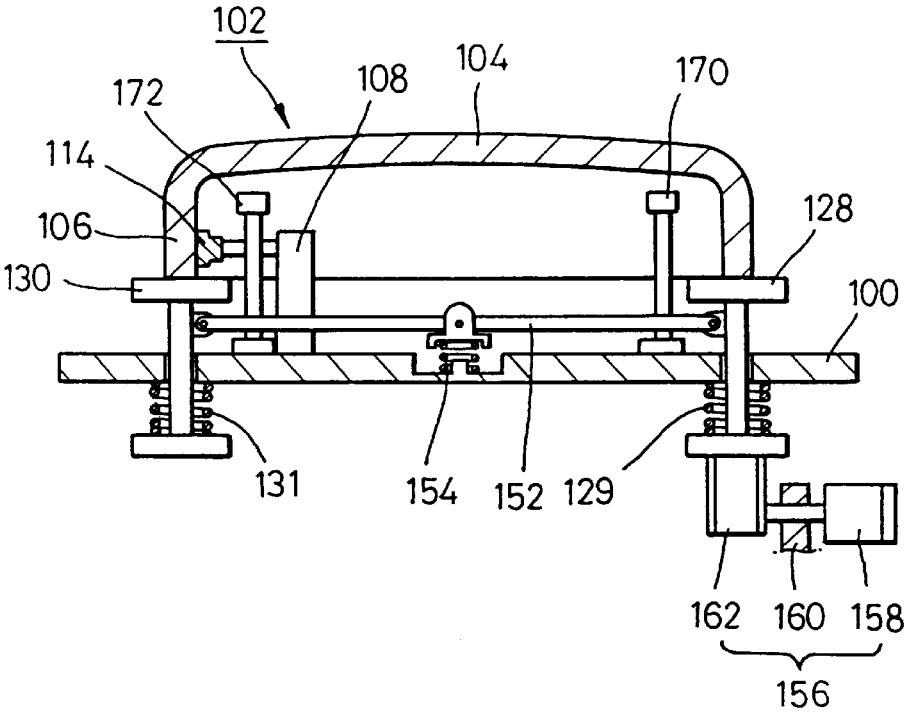
FIG. 8 is a sectional view taken along line VIII—VIII in FIG. 6.
Figure 9:
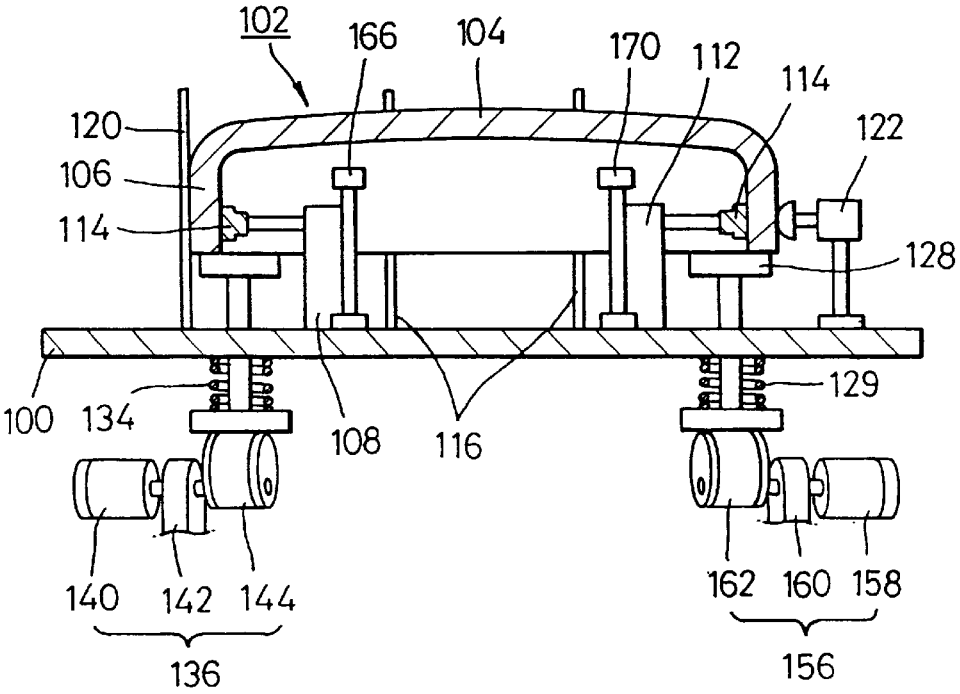
FIG. 9 is a sectional view taken along line IX—IX in FIG. 6.

As illustrated in FIG. 8, the first and second interlockedly adjustable support pads 128, 130 are operatively associated with each other by a tiltable yoke 152 which extends along a second diagonal line of the panel intersecting the first diagonal line. The tiltable yoke 152 is floatingly supported at it's medial section on the table 100 by virtue of a suspension spring 154. The respective one of the interlockedly adjustable support pads 128, 130 is normally biased downwards by springs 129, 131. Thus the movement of the first interlockedly adjustable support pad 128 in the upward direction will cause the second interlockedly adjustable support pad 130 to be moved downwards and vice versa. A third drive unit 156 is provided underneath the first interlockedly adjustable support pad 128. The third drive unit 156 includes a stepping motor 158 with an ouput shaft 160 and a cam 162 attached to the end of the output shaft 160 of the stepping motor 158. Due to the fact that the cam 162 continues to be in contact with the bottom surface of the first interlockedly adjustable support pad 128, the forward or reverse rotation of the stepping motor 158 will cause the first support pad 128 to be moved up and down, in response to which the second support pad 130 will be subject to elevational movement in the opposite direction.

The operation of the stepping motors 140, 146, 158 in the first through third drive units 136, 138, 156 is controlled by an electronic controller 164 that stores a reference plane on which the panel 102 shall lie. Unlike the embodiments illustrated in the drawings, the support pads may be subject to elevational movement through the use of other suitable drive means, including a pneumatic or hydraulic cylinder or a combination of stepping motor and ball screw, which should also fall within the scope of the invention.

Referring again to FIG. 6, it can be seen that first through fourth distance sensors 166, 168, 170, 172 are fixedly mounted on the table 100 to measure the height of four corner points of the interior surface of the panel face portion 104. After measuring the height of the four corner points, the distance sensors 166, 168, 170, 172 feed the measured data into the controller 164 which in turn determines whether the corner points lie on a predetermined reference plane. In the event that one or more of the corner points is determined to be out of the reference plane, the controller 164 will energize the stepping motors 140, 146, 158 in such a manner as to regulate the height of the support pads 124, 126, 128, 130 so that all of the corner points can be brought into the reference plane. A non-contact type photo sensor is advantageously used as the distance sensors 166, 168, 170, 172, while a contact type sensor may be employed on the condition that it leaves no mark on the panel surface. In any event, it would be preferred that the distance sensors should be made from a heat-resistant material and, if necessary, may be cooled down by a suitable cooling device.

Figure 14:
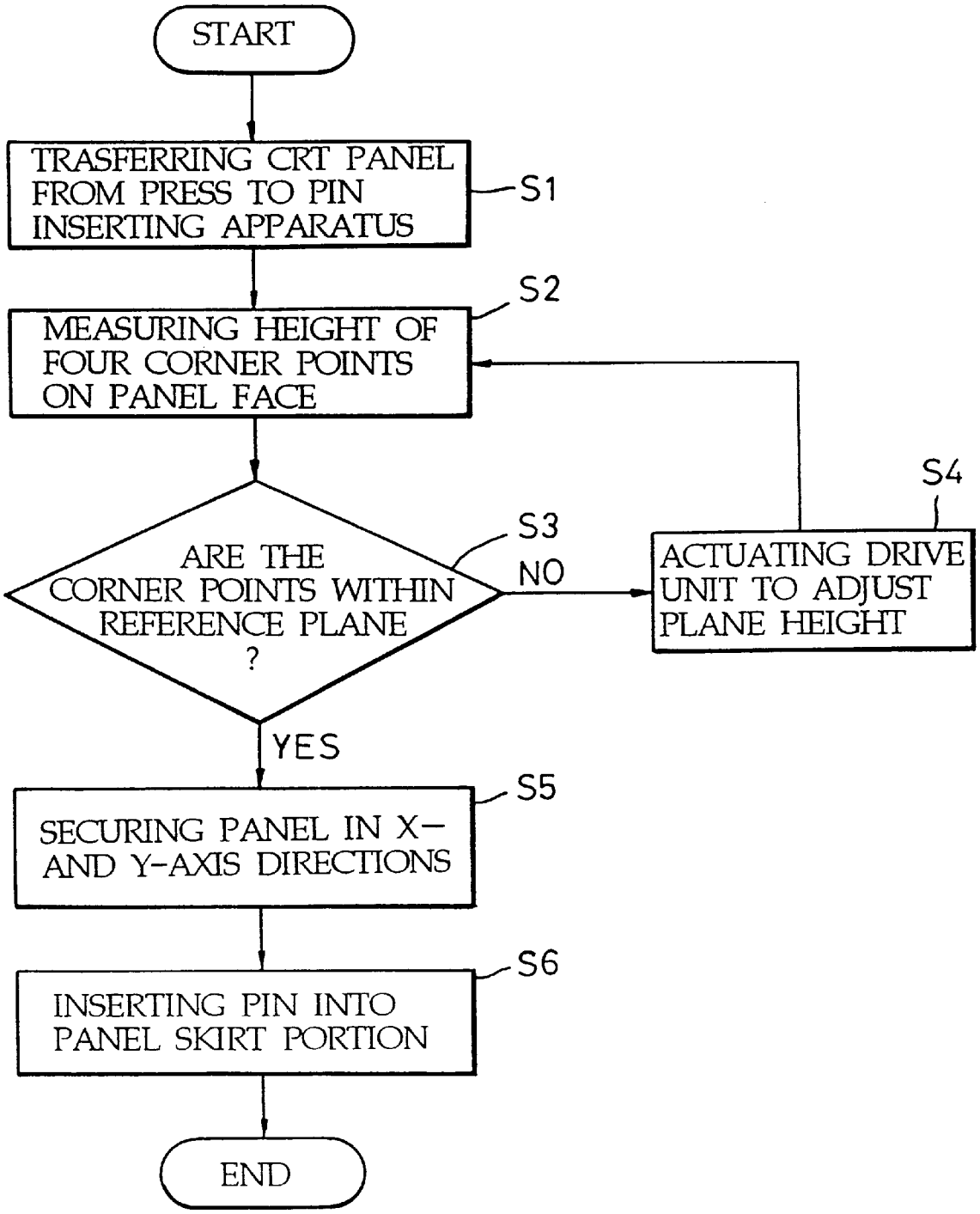
FIG. 14 is a flow chart showing the inventive process of positioning the panel and inserting the metal support pins into the panel.

Operation of the pin inserting apparatus in accordance with the first embodiment of the invention will now be set forth in detail with reference to FIGS. 6 and 14. As shown in FIG. 14, a panel 102 is transferred at a first step S1 to the pin inserting apparatus and then placed on the support pads 124, 126, 128, 130. At a second step S2, the distance sensors 166, 168, 170, 172 proceed to measure the height of the four corner points of the interior surface of the panel face portion 104. The height measurement data thus obtained are fed to the controller 164.

At a third step S3, the controller 164 that stores a predetermined reference plane will determine whether the four corner points are within the reference plane. The third step S3 will be passed to a fifth step S5 and then to a sixth step S6 if all of the corner points are determined to lie on the reference plane. In case of at least one of the corner points being out of the reference plane, the third step S3 will be fed back to the second step S2 via a fourth step S4. At the fourth step S4, the stepping motors 140, 146, 158 are operated to regulate or adjust the height of the support pads 124, 126 128, 130, assuring that all the corner points of the panel 102 are brought into the reference plane. The vertical displacement of the respective support pad can be decided in the following manner. As viewed in an X-Y coordinates whose origin coincides with the center point of the panel 102, the horizontal positions a,b,c,d of the respective one of the support pads 124, 126, 128, 130 are defined by:

| | |
|---|---|
| a(−xs, ys) | c(xs, ys) |
| d(−xs, −ys) | b(xs, −ys) |

If the height of the support pads at the above-defined horizontal positions is denoted as Ha, Hb, Hc, and Hd, the plane equation z of the support pads may be given:

$$z=\left(\frac{1}{2}-\frac{x}{4xs}+\frac{y}{4ys}\right)Ha+\left(\frac{1}{2}+\frac{x}{4xs}-\frac{y}{4ys}\right)Hb+\left(\frac{x}{4xs}+\frac{y}{4ys}\right)(Hc-Hd)$$

By using the above plane equation, it becomes possible to calculate the pad plane height z(A), z(B) corresponding to the first and second corner points of the panel 102 and the pad plane height difference z(C)−z(D) corresponding to the third and fourth corner points. The support pads 124, 126, 128, 130 should be caused to move up and down in case where the height HA, HB of the first and second corner points, and the height difference (HC−HD) between the third and fourth corner points do not coincide with the values defining the reference plane HAO, HBO, (HC−HD)O. Assuming that the height of the first and second independently adjustable support pads 124, 126 has been changed by ΔHa and ΔHb, with the height difference between the first and second interlockedly adjustable support pads 128, 130 changed by Δ(Hc−Hd), the height variation Δz(A), Δz(B), Δz(C−D) of the corner points can be calculated with the use of the above plane equation. Accordingly, the vertical displacement of the respective support pad is equal to HAO−HA, HBO−HB and (HC−HD)O−(HC−HD). Causing the support pads to move up and down by these values will bring the four corner points of the panel 102 into coincidence with the reference plane.

Once the vertical position of the panel 102 has been decided in the manner as described above, the Y-axis direction clamping devices 118 and the X-axis direction clamping device 122 are actuated at the fifth step S5 to secure the panel in the X, Y directions. At the sixth step S6, the pin transformers 108, 110, 112 are operated to heat the shadow mask support pin 114 received from the pin feeding device (not shown) to a temperature of, e.g., 1200° C., and subsequently force it into the skirt portion 106 of the cathode ray tube panel 102. When the pin inserting process comes to an end, the panel 102 is allowed to cool down as it passes through the lehr.

Figure 10:
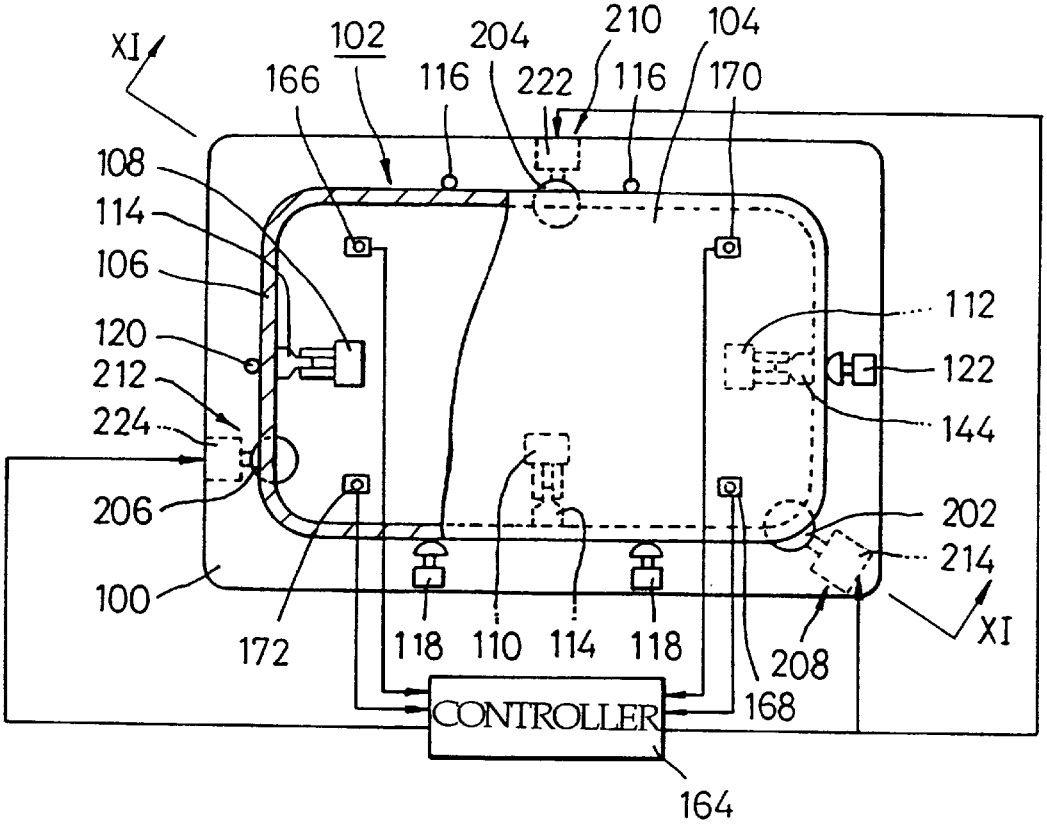
FIG. 10 is a top plan view showing a pin inserting apparatus in accordance with the second embodiment of the invention.
Figure 11:
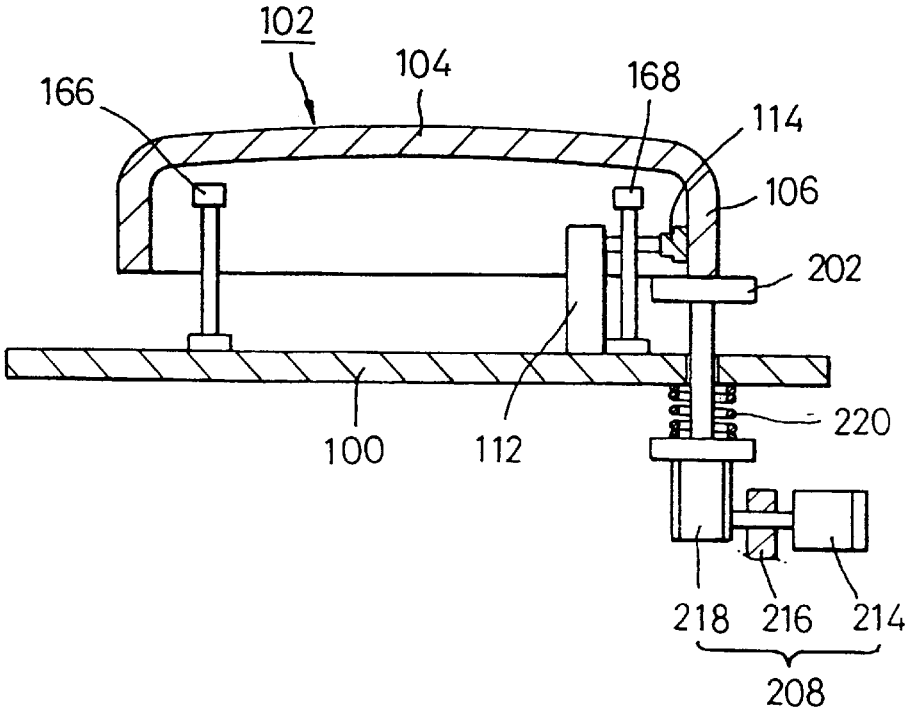
FIG. 11 is a sectional view taken along line XI—XI in FIG. 10.

Turning now to FIGS. 10 and 11, there is shown a pin inserting apparatus in accordance with the second embodiment of the invention. The pin inserting apparatus in this embodiment does not differ from the apparatus set forth supra, except that it employs first through third independently adjustable support pads 202, 204, 206 and first through third drive units 208, 210, 212 adapted to cause the support pads 202, 204, 206 to move up and down independently of one another. In other words, the second embodiment pin inserting apparatus is designed to support the panel skirt portion at three points, as opposed to the first embodiment pin inserting apparatus which supports the panel at four points. No description will therefore be given to the parts or components that have the same configuration and function as those of the first embodiment apparatus.

It can be seen in the second embodiment pin inserting apparatus that the first through third support pads 202, 204, 206 are arranged on the table 100 so as to stably support the panel 102 at three points. Each of the support pads 202, 204, 206 can be moved vertically upwards and downwards by means of the first through third drive units 208, 210, 212 whose operation is controlled by the controller 164 based on the input data from the first through fourth distance sensors 166, 168, 170, 172. As clearly indicated in FIG. 11, the first drive unit 208 includes a stepping motor 214 with an output shaft 216 and a cam 218 attached to the end of the output shaft 216 of the stepping motor 214 for making contact with the bottom surface of the first support pad 202. The first support pad 202 is normally urged against the cam 218 by virtue of a spring 220. Similarly, the second and third drive units 210, 212 include stepping motors 222, 224 for causing the corresponding support pads 204, 206 to move up and down.

Just because the second embodiment pin inserting apparatus is adapted to support the panel 102 at three points, the method of adjusting the height of the support pads 202, 204, 206 differs from the height adjusting method in the first embodiment pin inserting apparatus. Specifically, the step S4 in FIG. 14 is carried out in different way in the second embodiment, with the steps S1, S2, S3, S5 and S6 remaining unchanged. The vertical displacement of the first through third support pads 202, 204, 206 can be determined at the step S4 in the following manner.

Assuming that the horizontal positions a, b, c of the support pads 202, 204, 206 are represented by (xa, ya), (xb, yb) and (xc, yc) in a X-Y coordinates, with the height thereof being Ha, Hb and Hc, the plane equation z of the support pads is given:

$$z = [\{(xb*yc - xc*yb) - (yc - yb)*x + (xc - xb)*y\}*Ha + \{(xa*yc - xc*ya) + (yc - ya)*x - (xc - xa)*y\}*Hb + \{(xa + yb - xb*ya) - (yb - ya)*x + (xb - xa)*y\}*Hc]/N,$$

where N=(xb*yc+xc*ya*yb)−(xc*yb+xb*ya+xa*yc). In the event that the height of the support pads is changed in the amount of ΔHa, ΔHb, and ΔHc, the varation of the pad plane Δz(A), Δz(B), and Δz(D) can be readily calculated as a function of ΔHa, ΔHb and ΔHc by use of the plane equation noted just above. The variation of the pad plane thus obtained means the height variation of the four corner points on the interior surface of the panel face portion.

If the height of the corner points HA, HB and (HC−HD) or HCD is left deviated from the reference value HAO, HBO, and HCDO which defines the reference plane, the following equations has to be satisfied to bring the corner points into the reference plane:

$$\Delta z(A)=HAO-HA$$

$$\Delta z(B)=HBO-HB$$

$$\Delta[z(C)-\Delta z(D)]=HCDO-HDO$$

The above euations may be rearranged into the simultaneous equation as given below:

$$\begin{bmatrix} a1 & a2 & a3 \\ b1 & b2 & b3 \\ c1 & c2 & c3 \end{bmatrix}\begin{pmatrix} \Delta Ha \\ \Delta Hb \\ \Delta Hc \end{pmatrix} = \begin{pmatrix} \Delta A*N \\ \Delta B*N \\ \Delta CD*N/2 \end{pmatrix}$$

where a1, a2, a3, b1, b2, b3, c1, c2, c3, ΔA, ΔB, ΔCD and N represent the invariable numbers obtained in the process of calculation. The vertical displacement of the support pads ΔHa, ΔHb and ΔHc can be found by way of solving the simultaneous equation. Immediately after deciding the vertical displacement of the support pads, the controller 164 will cause the stepping motors 214, 222, 224 of the first through third drive units 208, 210, 212 to bring the support pads 202, 204, 206 into a desired height so that the panel 102 can be accurately located on the reference plane.

Figure 12:
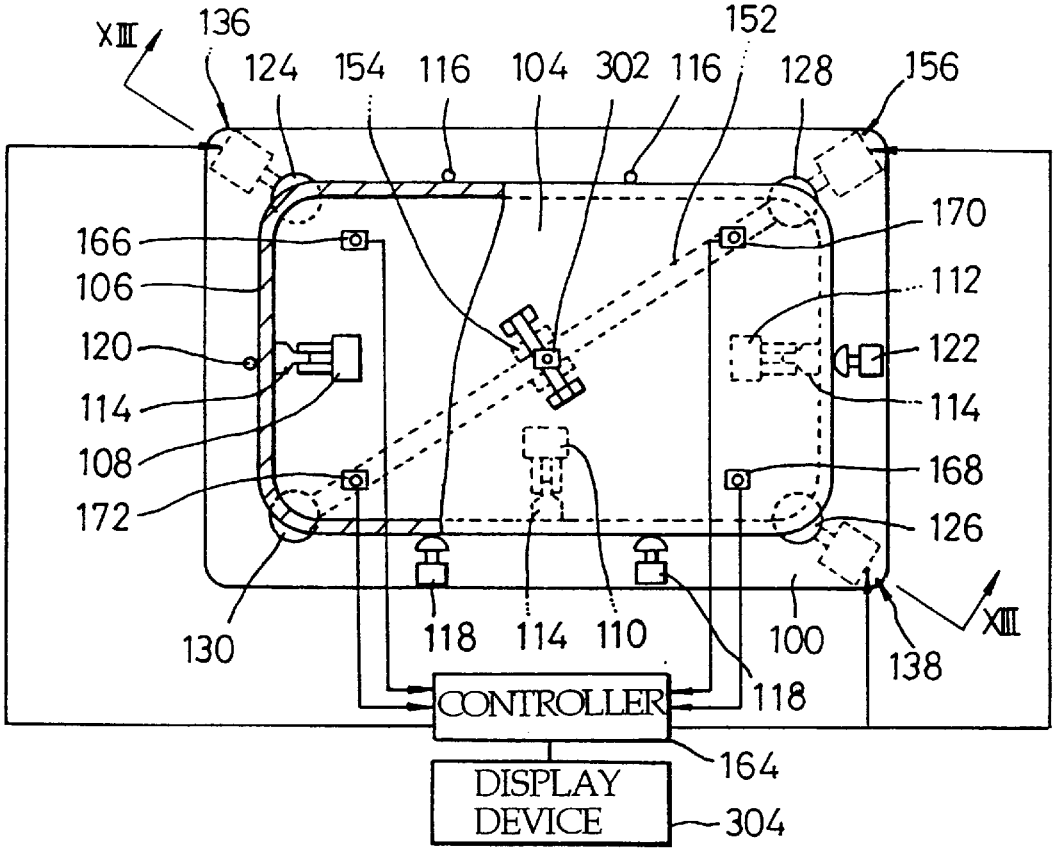
FIG. 12 is a top plan view showing a pin inserting apparatus in accordance with the third embodiment of the invention.
Figure 13:
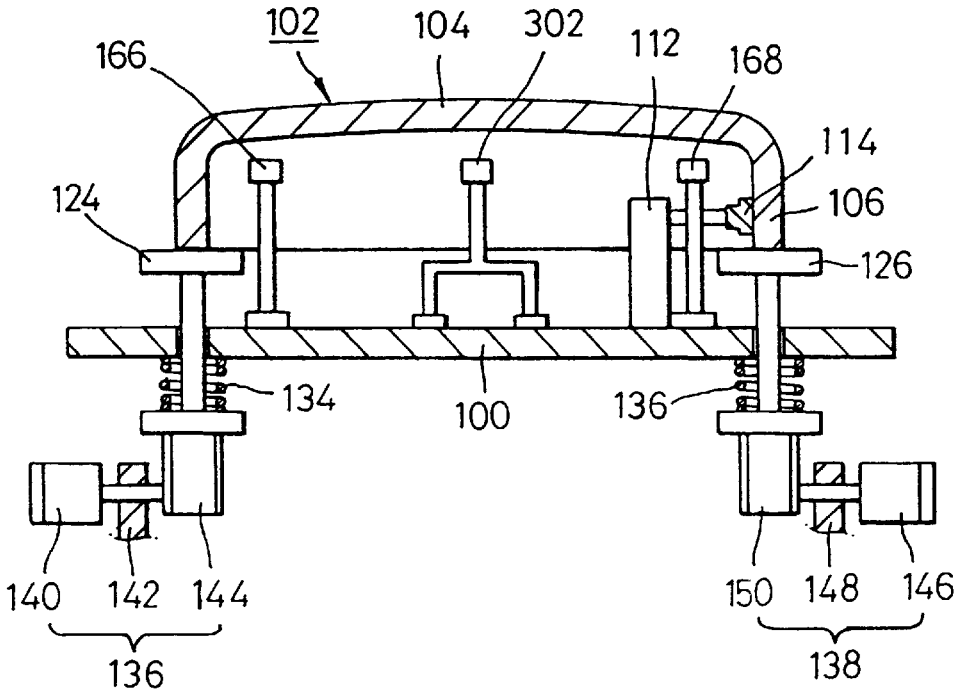
FIG. 13 is a sectional view taken along line XIII—XIII in FIG. 12.

Reference is made to FIGS. 12 and 13 which shows a pin inserting apparatus in accordance with the third embodiment of the invention. In addition to the parts contained in the first embodiment apparatus, the pin inserting apparatus of the third embodiment further includes a fifth distance sensor 302 mounted on the center of the table 100 for measuring the height of the center point of the panel 102 and a display device 304 electrically coupled the controller 164. Description is omitted for the same parts as set forth hereinabove in connection with the first embodiment.

The fifth distance sensor 302 cooperates with either the first and second distance sensors 160, 168 or the third and fourth distance sensors 170, 172 to detect the height of the two diagonally opposite corner points and the center point on the interior surface of the panel face portion. Based on the height as measured, the controller 164 can calculate the representative curvature value of the panel face portion 104 which is defined by the equation:

$$CC=HO-(HA+HB)/2$$

where HA, HB and HO means the height of the two diagonally opposite corner points and the center point of the face portion 104 of the panel 102.

The representative curvature value thus calculated is displayed on the display device 304 to notify the operator of the shrinkage degree of the panel 102. In the meantime, the representative curvature value is fed back to a press cooling device not shown in the drawings to control its operation. The press cooling device is controlled in a manner that it can raise the press temperature when the representative curvature value is higher than a reference value but lower down the temperature of the press when the representative curvature value is less than the reference value. This assures that the curvature of the successively produced cathode ray tube panels remains substantially consistent and uniform. Calculation of the representative curvature value is automatically done for all or a part of the panels transferred from the press.

While the invention has been shown and described with reference to preferred embodiments, it should be apparent to one of ordinary skill in the art that many changes and modifications may be made without departing from the spirit and scope of the invention as defmed in the claims.

What is claimed is:

1. A method of inserting a support pin into a cathode ray tube panel with a face portion and a skirt portion, comprising:

supporting the skirt portion of the panel at a plurality of support points;

measuring the height of corner points on the interior surface of the panel face portion;

determining whether the respective corner point lies in a predetermined reference plane;

changing the height of the support points to bring the corner points into the reference plane, when at least one of the corner points is determined to be out of the reference plane; and causing the support pin to be inserted into the skirt portion of the cathode ray tube panel.

2. The method of inserting a support pin into a cathode ray tube panel as recited in claim 1, wherein the skirt portion of the panel is supported at three support points.

3. The method of inserting a support pin into a cathode ray tube panel as recited in claim 1, wherein the skirt portion of the panel is supported at four support points.

4. The method of inserting a support pin into a cathode ray tube panel as recited in claim 1, wherein the step of measuring the height of the corner points is carried out by means of four distance sensors which correspond to the respective one of the corner points.

5. The method of inserting a support pin into a cathode ray tybe panel as recited in claim 2, wherein the height of the three support points is regulated independently of one another.

6. The method of inserting a support pin into a cathode ray tube pannel as recited in claim 3, wherein the four support points includes first and second independently adjustable support points disposed along a first diagonal line in a diagonally opposite relationship with each other and first and second interlockedly adjustable support points disposed along a second diagonal line in a diagonally opposite relationship with each other.

7. The method of inserting a support pin into a cathode ray tube panel as recited in claim 1, further comprising the step of measuring the height of a center point on the interior surface of the panel face portion.

8. The method of inserting a support pin into a cathode ray tube panel as recited in claim 7, further comprising the step of calculating representative curvature value CC by way of introducing the height of the corner points and the center point into the equation:

$$CC=HO-(HA+HB)/2$$

where HA and HB represent the height of two of the corner points lying along a single diagonal line of the panel and HO denotes the height of the center point.

9. The method of inserting a support pin into a cathode ray tube as recited in claim 1, further comprising the step of securing the panel in X-axis and Y-axis directions prior to the step of causing the support pin to be inserted into the skirt portion of the cathode ray tube panel.

10. An apparatus of inserting a support pin into a cathode ray tube panel with a face portion and a skirt portion, comprising:

a generally horizontal table;

a plurality of support pads mounted on the table for height-adjustably supporting the skirt portion of the panel;

drive means for causing the support pads to move in a generally vertical direction;

first to fourth distance sensors provided on the table for detecting the height of four corner points on the interior surface of the panel face portion;

control means for determining whether the respective corner point lies in a predetermined reference plane and for energizing the drive means to bring the corner points into the reference plane when at least one of the corner points is determined to be out of the reference plane; and means for causing the support pin to be forced into the skirt portion of the panel.

11. The apparatus of inserting a support pin into a cathode ray tube panel as recited in claim 10, wherein the plurality of support pads include first and second independently adjustable support pads disposed along a first diagonal line of the panel in a diagonally opposite relationship with each other and first and second interlockedly adjustable support pads disposed along a second diagonal line of the panel in a diagonally opposite relationship with each other.

12. The apparatus of inserting a support pin into a cathode ray tube panel as recited in claim 11, wherein the first and second interlockedly adjustable support pads are operatively associated with each other by means of a titable yoke which in turn is floatingly supported at it's medial section on the table via a suspension spring.

13. The apparatus of inserting a support pin into a cathode ray tube panel as recited in claim 10, wherein the plurality of support pads include first through third independently adjustable support pads elevationally movably mounted on the table to support the skirt portion of the panel at three support points.

14. The apparatus of inserting a support pin into a cathode ray tube panel as recited in claim 10, further comprising a fifth distance sensor provided on the table for detecting the height of a center point on the interior surface of the panel face portion.

* * * * *